US006776088B2

(12) United States Patent
Halt et al.

(10) Patent No.: US 6,776,088 B2
(45) Date of Patent: Aug. 17, 2004

(54) ENVIRONMENTALLY FRIENDLY PERSONAL IDENTIFICATION AND TRACKING SYSTEM

(76) Inventors: Andrew James Halt, 123 E. Third St., Media, PA (US) 19063; Gerald B. Halt, Jr., 123 E. Third St., Media, PA (US) 19063

( * ) Notice: Subject to any disclaimer, the term of this patent is extended or adjusted under 35 U.S.C. 154(b) by 35 days.

(21) Appl. No.: 09/886,491

(22) Filed: Jun. 21, 2001

(65) Prior Publication Data

US 2002/0195006 A1 Dec. 26, 2002

(51) Int. Cl.[7] ..... B41F 17/00; E01H 4/00

(52) U.S. Cl. ..... 101/36; 101/5; 101/38.1; 101/328; 101/375; 37/219; 37/223

(58) Field of Search ..... 101/5, 6, 18, 36, 101/38.1, 39, 103, 109, 328, 375; 172/315; 37/219, 221, 222, 223, 231, 285

(56) References Cited

U.S. PATENT DOCUMENTS

| | | | | | |
|---|---|---|---|---|---|
| 994,971 | A | * | 6/1911 | Beck | 101/103 |
| 1,707,149 | A | * | 3/1929 | Stamper | 101/119 |
| 4,050,168 | A | * | 9/1977 | Pace | 36/136 |
| 4,056,328 | A | * | 11/1977 | Maxey | 404/96 |
| 5,215,360 | A | * | 6/1993 | Buegel | 305/187 |
| 5,896,929 | A | * | 4/1999 | Dori | 172/1 |

* cited by examiner

*Primary Examiner*—Daniel J. Colilla
*Assistant Examiner*—Jill E. Culler
(74) *Attorney, Agent, or Firm*—Volpe and Koenig, P.C.

(57) ABSTRACT

A personal identification and tracking system comprising an impression means for providing a predetermined image upon an impressionable medium and an activation unit for moving the impression means between a first position, where said impression unit is in contact with the impressionable medium, and a second position whereby said impression unit is out of contact with said impressionable medium. The system is particularly adaptable to snow, sand or mud.

7 Claims, 4 Drawing Sheets

ENVIRONMENTALLY FRIENDLY PERSONAL IDENTIFICATION AND TRACKING SYSTEM

BACKGROUND

The present invention pertains generally to identification and tracking systems. More particularly, the present invention pertains to a system and method for permitting users to uniquely identify themselves while partaking in recreational activities on the ski slope or the beach.

Recreational activities, particularly sporting activities, are enjoyable for many reasons. Many recreational activities include some form of physical exercise which can either be part of a competition or part of a solo activity. Although the physical nature of recreational activities is enjoyable, other benefits include being outdoors in the fresh air and interacting with other people. It is often said that the social aspect of recreational activities is the main reason why most people enjoy such activities.

Some recreational activities, such as softball, volleyball, soccer and other team sports are inherently social since they require interaction among a plurality of team members. However, other sports such as downhill skiing, cross-country skiing, walking and jogging, do not necessarily lend themselves easily to social interaction between other people. These individualistic recreational activities, and other activities similar to them, could be greatly enhanced if a more social component was added to the activity.

Another drawback of individualistic recreational activities is that the person taking part in such an activity may find themselves in need of assistance. For example, if such a person is missing for an usually long period of time, it may be necessary to institute a search for the person. However, if the person was skiing, hiking or walking by themselves, a search can take unduly long and require a much greater amount of resources than would otherwise be necessary if the search party had a general idea of the whereabouts of the person. Accordingly, there is a need for a system and method for increasing the enjoyment and safety of individualistic recreational activities.

SUMMARY

The present invention is a system and method for identifying and tracking people who engage in selective individualistic recreational activities. The system includes a selectively activatable identification means which can uniquely identify the person engaged in the individualistic recreational activity. The identification means impresses a person's unique identification or other desired information upon an impressionable medium associated with the recreational activity, such as sand, snow or mud. The identification means may be changed as desired by the system user and also may be activated or deactivated as desired by the system user.

DETAILED DESCRIPTION OF THE PREFERRED EMBODIMENTS

Figure 1:
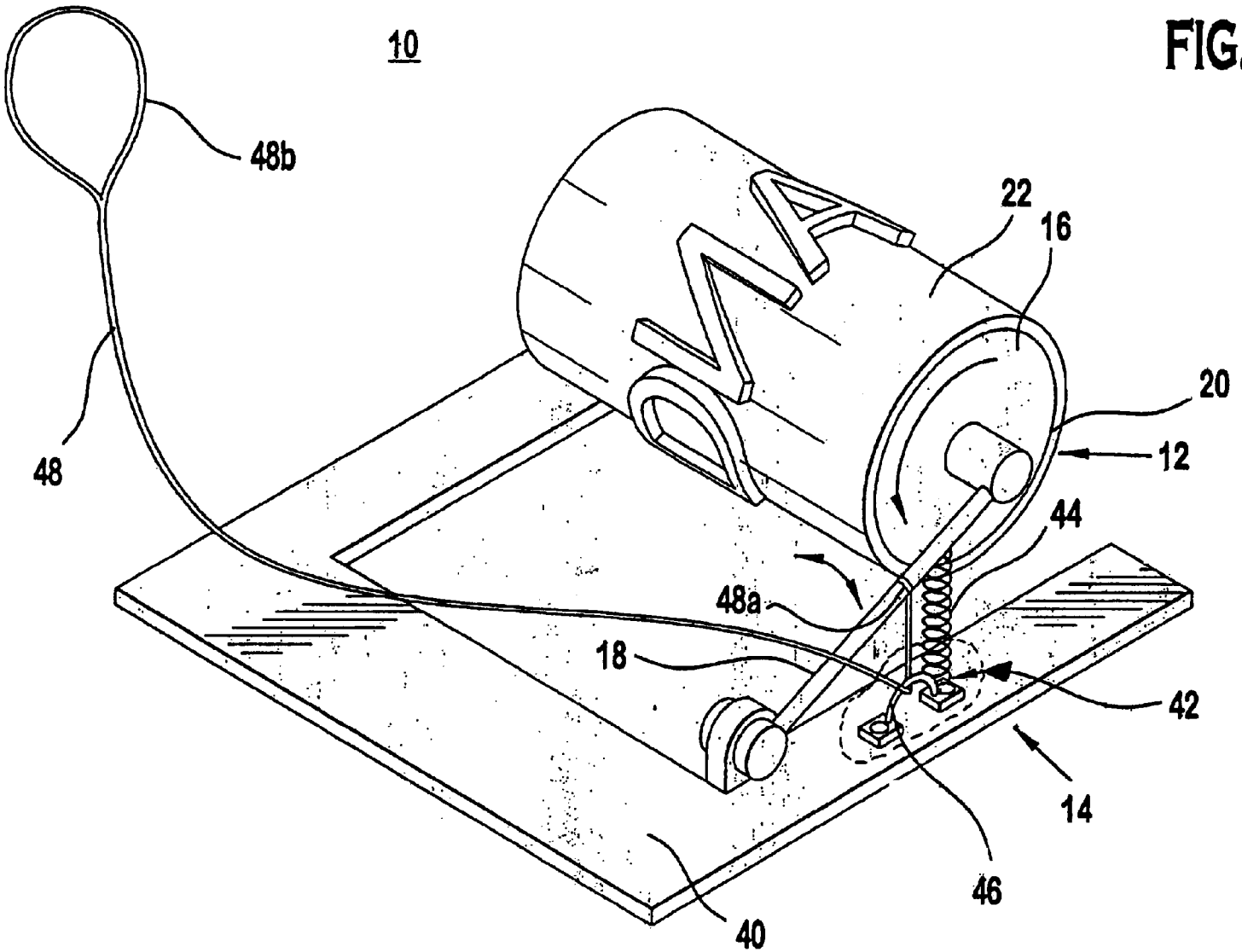
FIG. 1 is the identification system made in accordance with the present invention.

The preferred embodiment of the present invention will be described with reference to the drawing figures where like numerals represent like elements throughout.

Referring to FIG. 1, the identification system 10 of the present invention is shown in detail. As shown, the system 10 includes an identification unit 12 and a motivation unit 14.

The identification unit 12 comprises a cylindrical drum 16 which is rotatably connected to a bracket 18, which permits the cylindrical drum 16 to freely rotate. An impression pad 22 surrounds the cylindrical drum 16. A fastener 20 (such as Velcro® brand hook and loop fastener), securely fixes the impression pad 22 to the cylindrical drum 16.

Figure 2:
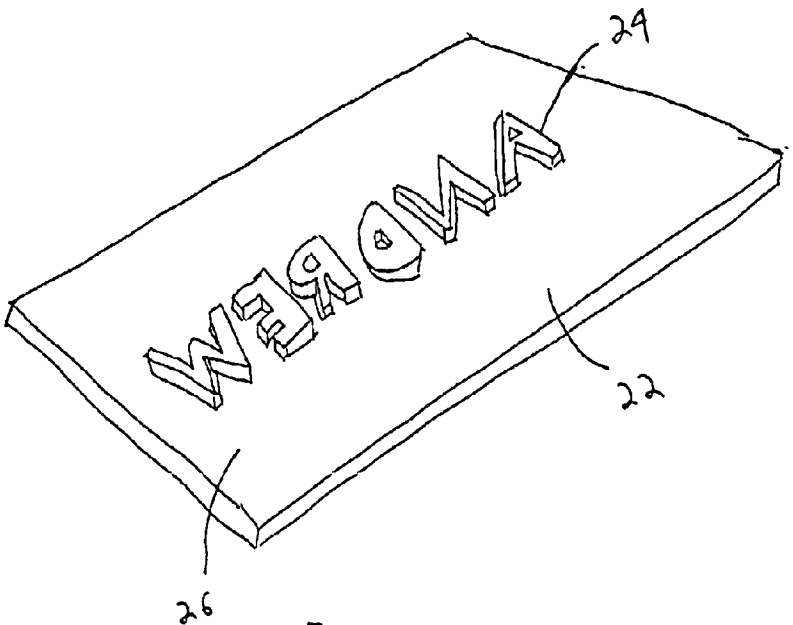
FIG. 2 is the impression pad portion of the identification unit.

As shown in FIG. 2, the impression pad 22 comprises a flexible material, such as rubber, plastic or the like, having raised areas 24 and depressed areas 26. Preferably, the raised areas 24 and depressed areas 26 are selectively positioned such that they provide a pattern or a message. For example, as shown, they may provide the name of a person "Andrew", the inventor of the present invention. Alternatively, the raised and depressed portions 24, 26 may include patterns, such as a company's logo; a selective arrangement of numbers and letters, such as a social security number or a phone number; or may include an emergency assistance message such as "I'm lost—please help". Virtually any message can be displayed using selective positioning of raised areas 24 and depressed areas 26.

Figure 3:
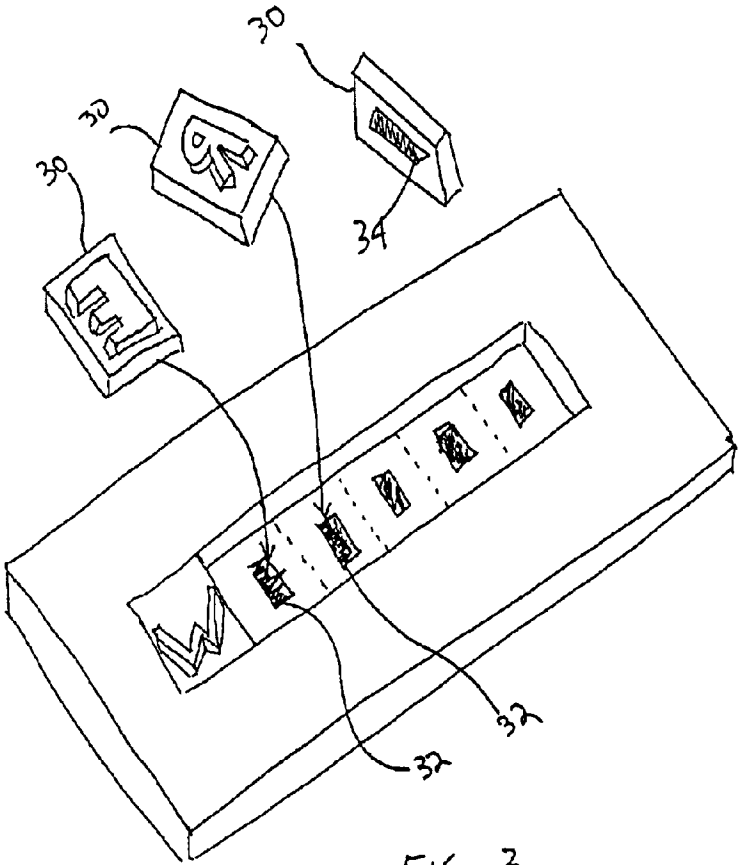
FIG. 3 is an alternative embodiment of the impression pad that includes a system of exchangeable blocks.

It should also be noted that although the impression pad 22 is preferably flexible, the raised areas 24 and depressed areas 26 need not be permanent. For example, as shown in FIG. 3 a system of interlocking or non-interlocking rubber or otherwise flexible or non-flexible blocks 30 may be provided, which are held in alignment by a fixing means, such as a Velcro® fastener. As shown, the hook portion 32 of the Velcro® fastener 20 may be located on the impression pad 22 and the loop portion 34 of the Velcro® fastener 20 may be located on the blocks 30. Other fixing means such as a magnetized arrangement, a mechanical locking system, a bolt or other type of mechanical fastener, or even a glue or liquid fastener may be used. The specific means for providing a selective pattern of raised portions 24 and depressed portions 26 is not central to the present invention, and it should be appreciated as such by those of skill in the art.

Referring back to FIG. 1, the motivational unit 14 includes a chassis 40 and a motive unit 42. The chassis 40 is configured to receive the bracket 18 in such a way as to permit the bracket 18 to rotatably move about the chassis 40.

The motive unit 42 provides a motive force such that the bracket 18 is forced down and the impression pad 22 presses against the desired surface. The motive unit 42 may be as simple as the embodiment shown in FIG. 1, which includes a spring 44, a loop 46 and a cord 48. One end 48*a* of the cord 48 is attached to the bracket 18, and the other end 48*b* of the cord 48 is preferably configured as a loop, for accommodating the hand of the user. The cord 48 is passed through the loop 46 such that when tension is applied to the cord 48 by the user, the bracket 18 is pulled down to compress the spring 44 and force the impression pad 22 against the desired surface. When the tension on the cord 48 is decreased by the user, the spring 44 provides an upward force such that the bracket 18 and the impression pad 22 are forced away from the desire surface.

Figure 4:
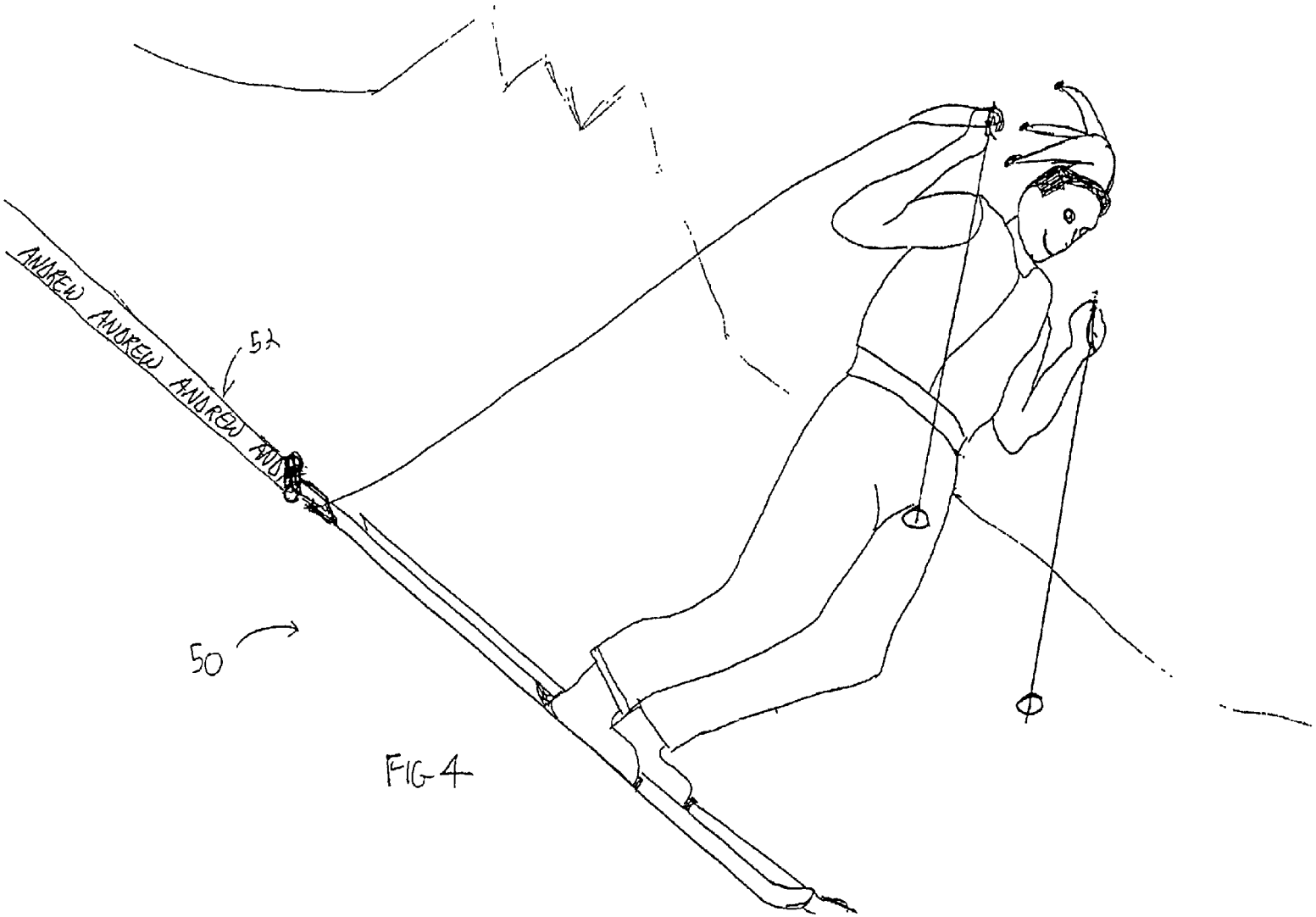
FIG. 4 shows the identification and tracking system of the present invention in operation.

In operation, as shown in FIG. 4 with reference to the application of the present invention on a downhill ski, as the skier activates the system by applying tension to the cord 48, the message on the impression pad 22 is transferred to, and imprinted upon, the snow 50, thereby leaving a repeating message 52 upon the snow 50. This message 52 can be a recreational use such that one person can follow the tracks of another person. This can result in many people taking part in an activity which was generally deemed as an individualistic recreational activity. The message 52 can also be used to track such a person.

Figure 5:
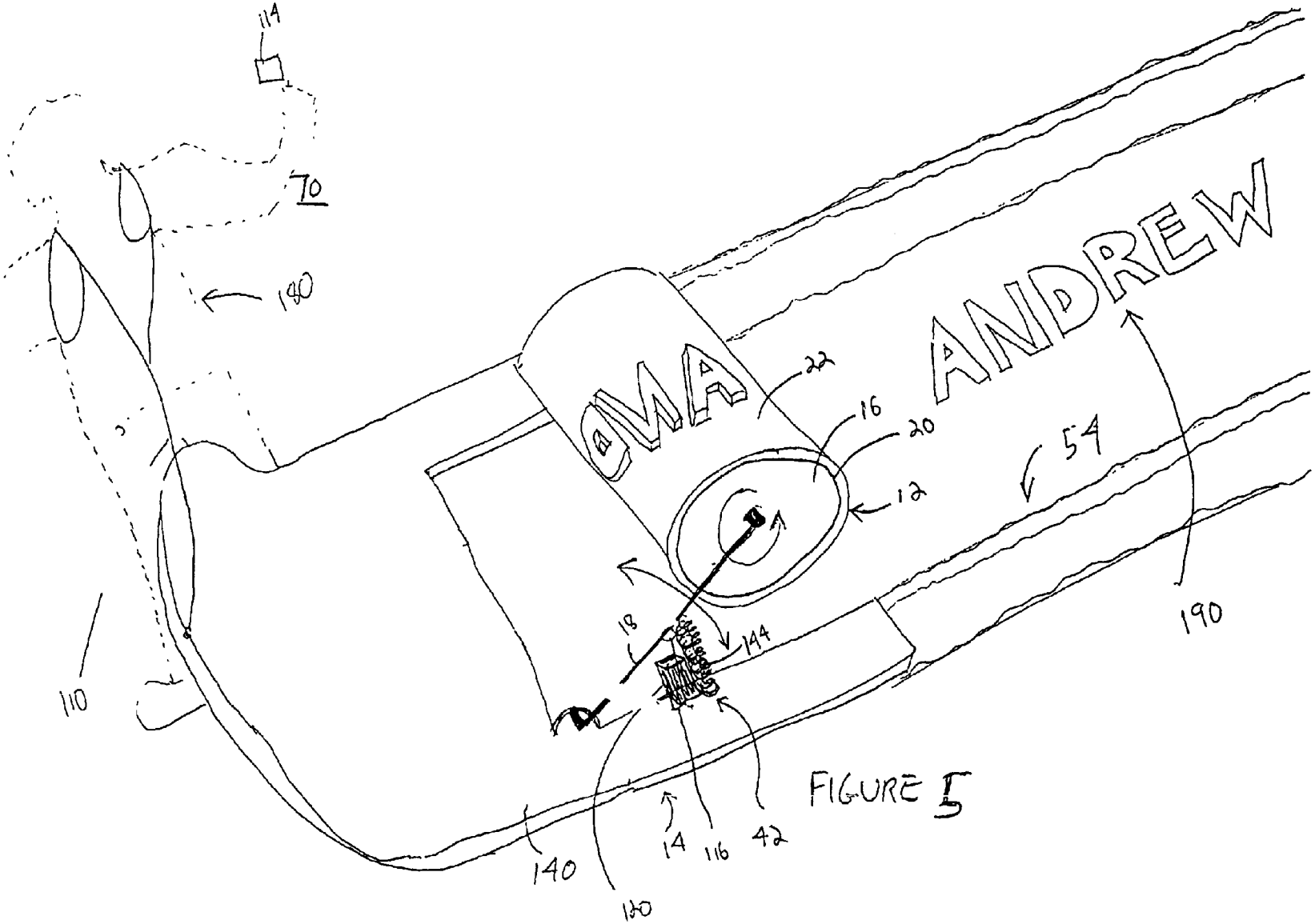
FIG. 5 is an alternative embodiment of the present invention for use when the impressionable medium is sand.
Figure 1:
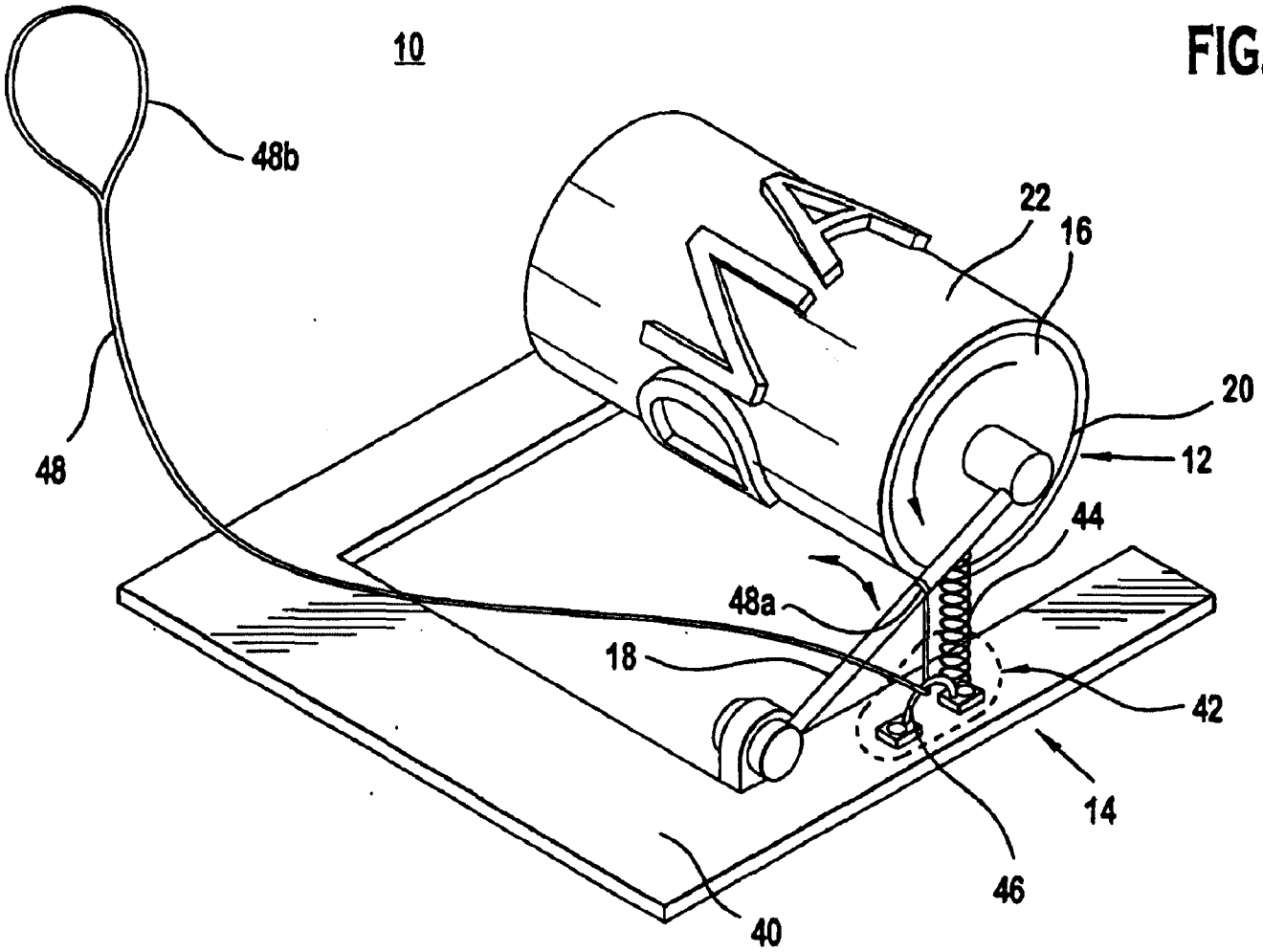
Figure 2:
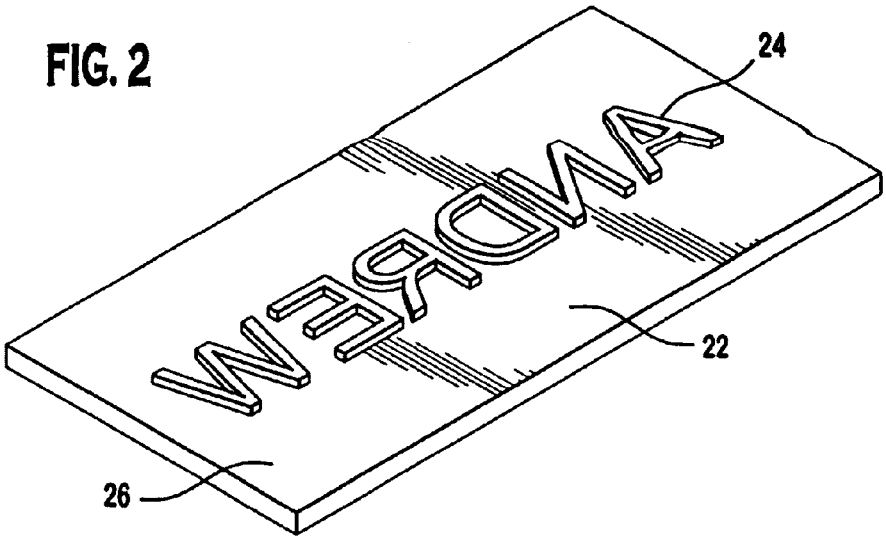
Figure 3:
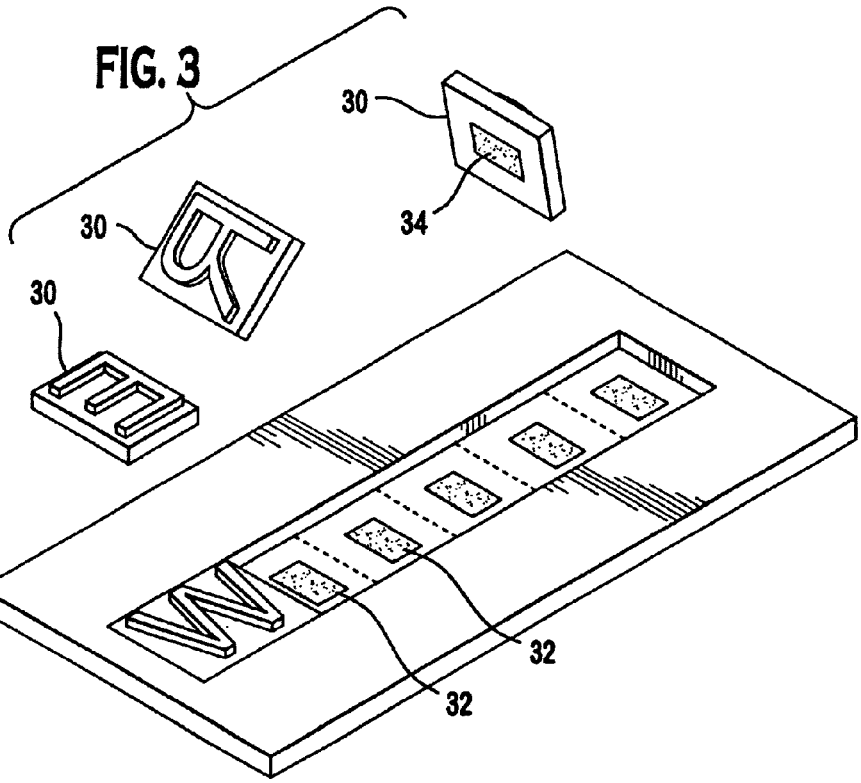
Figure 4:
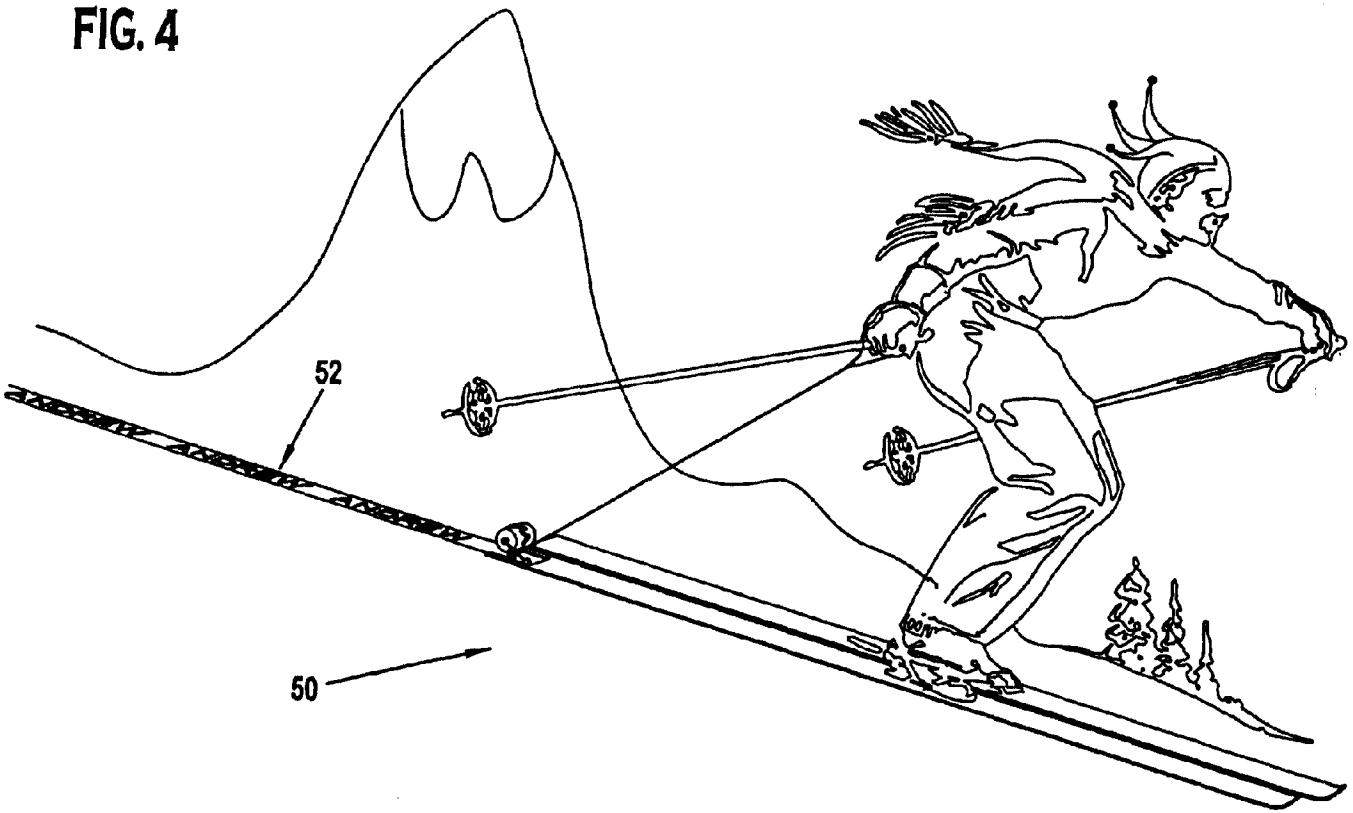
Figure 5:
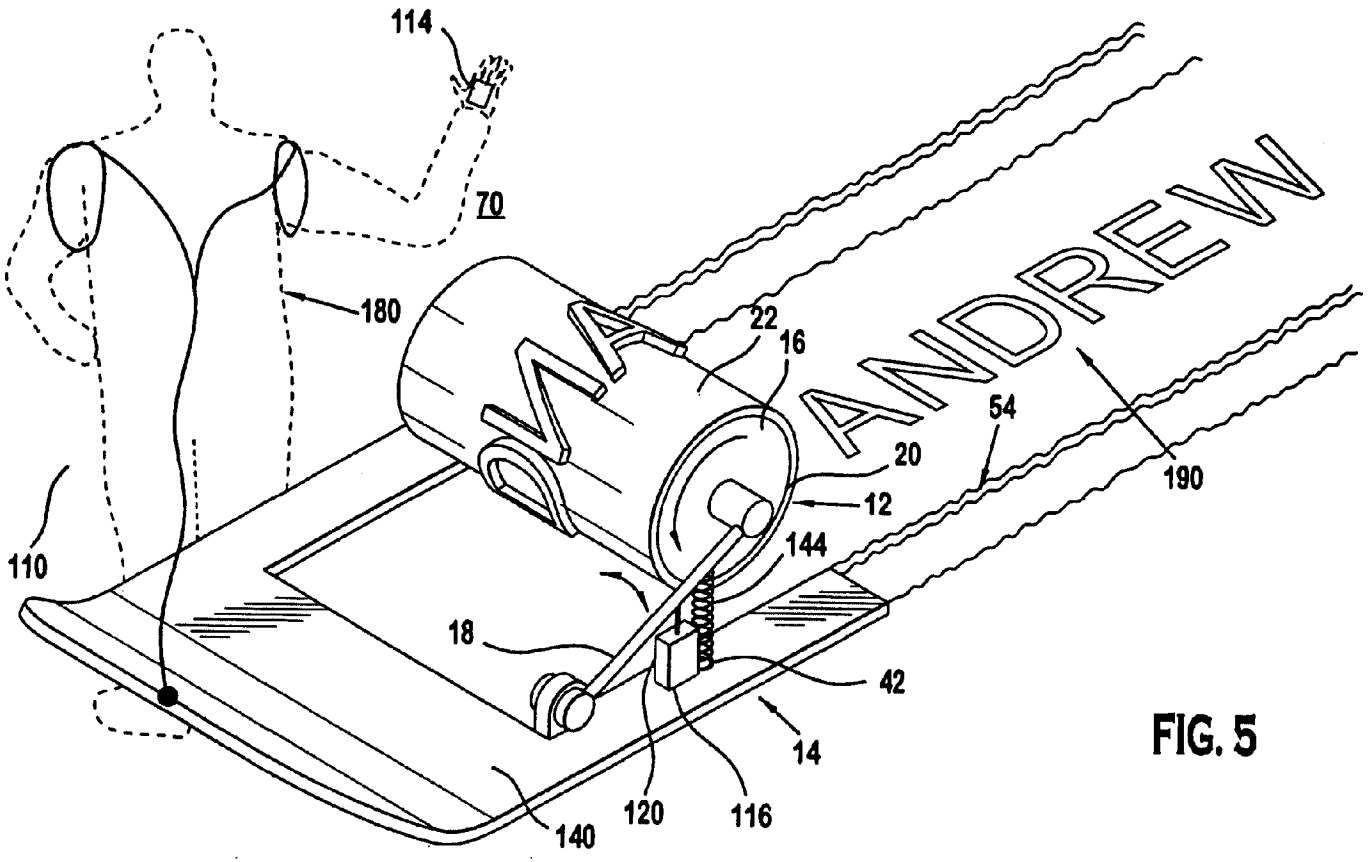

With reference to FIG. 5, it is shown an application of the present invention which is adapted for recreational activities on the beach 54. The portions of the system 70 of this embodiment which are common to FIG. 1 are numbered with like numerals. However, this embodiment also includes a harness 110, an electrical motor 120, a battery (not shown) and a wireless control system, comprising a wireless transmitter 114 and a wireless receiver 116.

The chassis 140 is shaped like a sled, to permit the system 70 to slide along the sand 54 when hauled by the user 180, (shown in phantom). Additionally, in this embodiment, the motive force is shown as a small electrical motor 120 with a screw drive 144 which permits the bracket 18 to be forced both upward and downward. The electrical motor 120 is coupled to the wireless receiver 116. When the user 180 desires to activate the system 70, the user presses a "down" button on the wireless transmitter 114, which sends an appropriate RF command signal to the wireless receiver 116. The wireless receiver 116 energizes the electrical motor 120 to move the bracket 18 toward the surface of the beach 54, thereby permitting the impression pad 22 to contact the beach 54 and permit the cylindrical drum 16 to rotate. As with the skiing application, a repeating message 190 is impressed upon the sand 54, to permit identification and tracking of the user 180. When the "up" button on the wireless transmitter 114 transmitter is depressed, an appropriate command signal is sent to the wireless receiver 116. The wireless receiver 116 energizes the electrical motor 120 to reverse the screw drive 144 and move the bracket 18 away from the surface of the beach.

It should be noted that the present invention provides great benefits to individualistic activities while introducing no environmentally harmful effects upon the ski slope or the beach.

While the present invention has been described in terms of the preferred embodiment, other variations which are within the scope of the invention as outlined in the claims below will be apparent to those skilled in the art.

What is claimed is:

1. A personal identification and tracking system comprising:

impression means for providing a predetermined image upon an impressionable medium; and activation means for moving said impression means between a first position, whereby said impression means is in contact with said impressionable medium, and a second position whereby said impression means is out of contact with said impressionable medium; said activation means comprising:

a flat base;

a lever, rotatably coupled to said impression means and pivotally coupled to said base, for permitting said impression means to pivot between said first position and said second position;

a spring, for forcing said lever into said second position; and a cable, for manual engagement by a user, for opposing the force of said spring, whereby when said cable is engaged, said spring is compressed and said impression means is moved into said first position and when said cable is disengaged, said spring is decompressed and said impression means is moved into said second position;

whereby said impressionable medium is selected from the group consisting of snow, sand and mud.

2. The system of claim 1 whereby said impression means comprises a cylindrical drum which is rotatably connected to said activation means; whereby said predetermined image is created as the cylindrical drum rotates across said impressionable medium.

3. The system of claim 2 whereby said cylindrical drum comprises areas of different heights which form said predetermined image.

4. The system of claim 3 whereby said areas of differing heights comprise at least two separate blocks, each of which has a predefined character embossed thereon.

5. The system of claim 1 further comprising a sled for supporting said activation means, thereby permitting said system to glide across said impressionable medium.

6. The system of claim 1 further including a bracket for attaching said system to a snow ski.

7. The system of claim 1 further including a bracket for attaching said system to a snow board.

* * * * *

UNITED STATES PATENT AND TRADEMARK OFFICE

CERTIFICATE OF CORRECTION

PATENT NO. : 6,776,088 B2
DATED : August 17, 2004
INVENTOR(S) : Halt et al.

It is certified that error appears in the above-identified patent and that said Letters Patent is hereby corrected as shown below:

The title page, showing the illustrative figure, should be deleted and replaced with the attached title page.

The drawing sheets, consisting of Figs. 1-5, should be deleted and replaced with drawing sheets, consisting of Figs. 1-5, as shown on the attached pages.

Signed and Sealed this

Thirtieth Day of May, 2006

JON W. DUDAS
*Director of the United States Patent and Trademark Office*

(12) United States Patent
Halt et al.

(10) Patent No.: US 6,776,088 B2
(45) Date of Patent: Aug. 17, 2004

(54) ENVIRONMENTALLY FRIENDLY PERSONAL IDENTIFICATION AND TRACKING SYSTEM

(76) Inventors: Andrew James Halt, 123 E. Third St., Media, PA (US) 19063; Gerald B. Halt, Jr., 123 E. Third St., Media, PA (US) 19063

( * ) Notice: Subject to any disclaimer, the term of this patent is extended or adjusted under 35 U.S.C. 154(b) by 35 days.

(21) Appl. No.: 09/886,491

(22) Filed: Jun. 21, 2001

(65) Prior Publication Data

US 2002/0195006 A1 Dec. 26, 2002

(51) Int. Cl.[7] ..... B41F 17/00; E01H 4/00

(52) U.S. Cl. ..... 101/36; 101/5; 101/38.1; 101/328; 101/375; 37/219; 37/223

(58) Field of Search ..... 101/5, 6, 18, 36, 101/38.1, 39, 103, 109, 328, 375; 172/315; 37/219, 221, 222, 223, 231, 285

(56) References Cited

U.S. PATENT DOCUMENTS

| | | | | | |
|---|---|---|---|---|---|
| 994,971 | A | * | 6/1911 | Beck | 101/103 |
| 1,707,149 | A | * | 3/1929 | Stamper | 101/119 |
| 4,050,168 | A | * | 9/1977 | Pace | 36/136 |
| 4,056,328 | A | * | 11/1977 | Maxey | 404/96 |
| 5,215,360 | A | * | 6/1993 | Buegel | 305/187 |
| 5,896,929 | A | * | 4/1999 | Dori | 172/1 |

* cited by examiner

*Primary Examiner*—Daniel J. Colilla
*Assistant Examiner*—Jill E. Culler
(74) *Attorney, Agent, or Firm*—Volpe and Koenig, P.C.

(57) ABSTRACT

A personal identification and tracking system comprising an impression means for providing a predetermined image upon an impressionable medium and an activation unit for moving the impression means between a first position, where said impression unit is in contact with the impressionable medium, and a second position whereby said impression unit is out of contact with said impressionable medium. The system is particularly adaptable to snow, sand or mud.

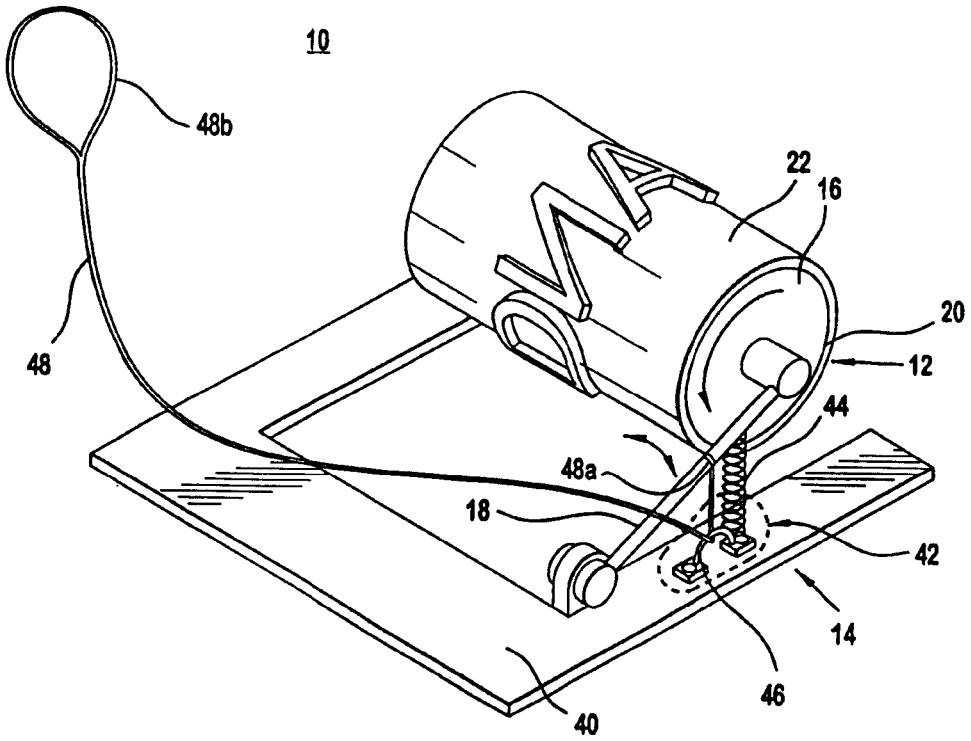

7 Claims, 4 Drawing Sheets